US005960242A

United States Patent [19]

Greive

[11] Patent Number: 5,960,242

[45] Date of Patent: Sep. 28, 1999

[54] METHOD AND PRINTING APPARATUS USING HEATING AND COOLING TO APPLY TONER TO A SUBSTRATE

[75] Inventor: Martin Greive, Schoenau, Germany

[73] Assignee: Heidelberger Druckmaschinen AG, Heidelberg, Germany

[21] Appl. No.: 09/016,212

[22] Filed: Jan. 30, 1998

[30] Foreign Application Priority Data

Jan. 31, 1997 [DE] Germany ..... 197 03 559

[51] Int. Cl.[6] ..... G03G 15/01; G03G 15/16; G03G 15/20

[52] U.S. Cl. ..... 399/302; 399/299; 399/307

[58] Field of Search ..... 399/299, 302, 399/308, 307, 341, 312, 313, 320; 347/154, 155, 156; 430/124, 126

[56] References Cited

U.S. PATENT DOCUMENTS

| | | | |
|---|---|---|---|
| 4,015,027 | 3/1977 | Buchan et al. | 430/124 |
| 4,992,833 | 2/1991 | Derimiggio | 399/308 |
| 5,124,730 | 6/1992 | Lewicki, Jr. | 430/126 X |
| 5,216,466 | 6/1993 | Mitani | 399/154 |
| 5,436,104 | 7/1995 | Yasuda et al. | 430/124 |

FOREIGN PATENT DOCUMENTS 9-330006 12/1997 Japan .

*Primary Examiner*—Joan Pendegrass
*Attorney, Agent, or Firm*—Kenyon & Kenyon

[57] ABSTRACT

A method for applying toner to a substrate by a printing unit of a printing machine, a print image being applied to a carrier band (5) and passed by the latter to the substrate to be printed, e.g. paper (2), which is transported through the printing unit via a transport band (4), the paper (2) to be printed and the applied toner being cooled by means of a cooling device (8) arranged over a longer segment, and the toner applied to the paper (2) being heated before and/or during the transfer process from the intermediate carrier to the paper (2), by a heating device (7) arranged over a longer segment, and that the heating and cooling energy, respectively, to be supplied is adjustable in accordance with the desired printing speed.

2 Claims, 1 Drawing Sheet

METHOD AND PRINTING APPARATUS USING HEATING AND COOLING TO APPLY TONER TO A SUBSTRATE

FIELD OF THE INVENTION

The present invention relates to a method for applying toner, which is located on a charge carrier, for example a cylinder, and is transferred from the charge carrier to an intermediate carrier or to a substrate, for example paper. The present invention relates as well to a printing apparatus for applying toner.

RELATED TECHNOLOGY

In order to be able to transfer toner from an intermediate carrier to a substrate, the adhesion of the toner on the substrate must be greater than that on the intermediate carrier. In the transfer process, however, fracturing of the toner material always takes place, so that part of it remains on the intermediate carrier. It is thus almost practically impossible to achieve a one-hundred percent transfer of the toner to the substrate.

Electrostatic transfer techniques are known, with which a degree of transfer effectiveness of a maximum of approximately 95% to 98% can be achieved, but this can only be done when using non-conductive toner. For printing machines with a printing output of many thousands of sheets per hour, this is not sufficient, however, since the cleaning devices have to be permanently replaced or cleaned outside of the printing machine. In a reference with the title "Offset Quality Electrophotography" in the "Journal of Imaging Science and Technology," Vol. 37, No. 5, September/October 1993, p. 485 (referred to as "OQE" below), various xerographic techniques, which are suitable for the transfer of conductive toner, even under conditions of high humidity, are mentioned. One of these techniques is comprised of transferring the toner to a substrate under pressure, and fixing it in place at the same time. Another technique is comprised of thermal transfer with two temperature stages.

Furthermore, there are combinations of print transfer and thermal transfer. Such a combination is shown on page 459 of OQE. The toner is transferred from a first cylinder to an intermediate cylinder, by means of pressure, and then transferred to a paper, which passes between the intermediate cylinder and a hot counter-pressure cylinder, by means of thermal transfer. In connection with the transfer using pressure, a method of effectiveness of 95% is reportedly achieved, and in connection with thermal transfer, it is said to be 100%.

In the journal "Seybold-Report and Publishing Systems," Vol. 24, No. 20, p. 20, left column (referred to as "Seybold-Report" below), a transfer system is described, in which the paper is transferred via two webs. The first web holds the toner in a distribution corresponding to the print image. The image is then transferred to the second web, which is heated. This web is not hot enough to melt the toner; however, it causes the toner particles to adhere to one another and then transfers the image to the paper, which is preheated, the image being fixed in place by a hot pressure roller. This means that no further melting or fixation of the toner is required.

Another problem in the transfer of toner is making available sufficiently high energy to melt or partially melt the toner before or during its transfer. In the case of machines that run at high speed, the toner must be melted during the short time available, requiring a high expenditure of energy.

However, in the first step, during the transfer from the first web to the second web, it is not possible to achieve a transfer effect of 100%. It is true that the first web is TEFLON-coated, but it fundamentally exerts at least low adhesion forces on the toner, so that at least in the first step, a degree of transfer effectiveness of less than 100% must be assumed—similar to the technique described in the "OQE" reference. In the two techniques described above, the toner is therefore not transferred completely from the first cylinder and the first web, respectively. Particularly in the case of newer printing techniques, e.g. the printing technique described in the "Seybold-Report," it is necessary, however, in order to achieve a perfect print, to completely remove the remaining printing ink before a new image is applied to the first web and the first cylinder, respectively.

SUMMARY OF THE INVENTION

The present invention is based on the task of creating a transfer technique which guarantees complete transfer in the case of transfer from an intermediate carrier to a substrate, and in which the transfer behavior of the toner can be regulated.

The present invention therefore provides a method for applying toner to a substrate by a printing unit of a printing machine, a print image being applied to a carrier band (5) and passed by the latter to the substrate to be printed, e.g. paper (2), which is transported through the printing unit via a transport band (4). The paper (2) to be printed and the applied toner are cooled by means of a cooling device (8) arranged over an elongated segment, and that the toner applied to the paper (2) is heated before and/or during the transfer process from the intermediate carrier to the paper (2), by a heating device (7) arranged over an elongated segment, and that the heating and/or cooling energy to be supplied is adjustable in accordance with the desired printing speed.

The present invention also provides a printing machine for applying toner to a substrate, comprised of a carrier band (5), on which the toner image is located, and a transport band (4), on which the substrate is located. A heating device (7) for heating the carrier band (5) and a cooling device (8) for cooling the transport band (4) are provided, both the heating device (7) and the cooling device (8) acting on the band in each instance over an elongated segment distance.

By using individual heating and cooling, the release behavior and the holding force, respectively, of the toner on the carrier band can be determined or influenced in an advantageous manner.

Furthermore, lengthening of the heating and cooling segment (as compared with the state of the art) has an advantageous effect. In this way, the melting time for the toner can be influenced. Fundamentally, more time is available, and therefore the printing operation can be performed at a higher speed. The longer cooling segment has an analogous advantageous effect on the printing speed and the toner adhesion.

DETAILED DESCRIPTION

Figure 1:
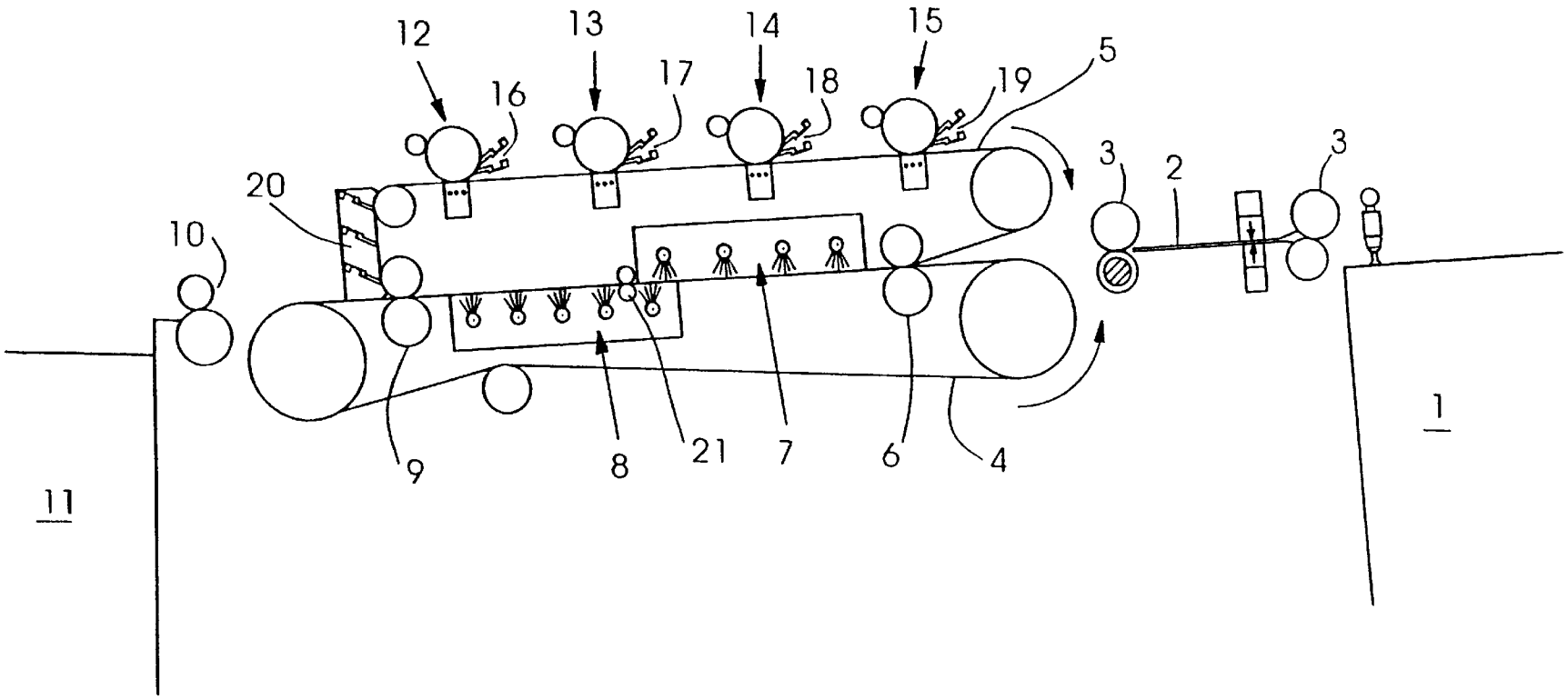
FIG. 1 shows the apparatus of the present invention for transfer of toner and the like to a substrate, for example paper.

FIG. 1 shows a feeder 1, which feeds the appropriate substrate, for example paper, to the printing apparatus via transport rollers 3. The printing apparatus itself is comprised of two bands, upper band 5 being provided for transport of the toner image and lower band 4 being provided for transport of the substrate, i.e. paper 2, through the printing unit. The toner image is generated on a charge carrier cylinder 12, 13, 14, 15. Furthermore, a heating segment 7 and a cooling segment 8 are provided. Heating 7 serves to warm the toner particles and the paper. Cooling 8 serves to cool the toner particles and paper 2. Furthermore, toner pressure rollers 9 and 6 are provided, which serve to fix the toner in place on the paper. Printed paper 2 is passed to a delivery device 11 via transport rollers 10. Furthermore, cleaning units 17, 18, 19, 20 are provided for removing excess toner.

The method according to the invention can be described as follows, on the basis of FIG. 1. Paper 2, which is to be printed, comes from feeder 1 and is passed to the printing unit via transport rollers 3. To prepare the print image, charge carriers 12, 20 13, 14, 15 are provided, which make it possible to create a four-color image. Toner with a certain color is passed to each of these charge carriers 12, 13, 14, 15.

In the present exemplary embodiment, four different toner colors will therefore be used. In accordance with the charge applied to each of charge carriers 12, 13, 14, 15, the toner connected with the charge carrier in each instance will deposit on the charge carrier in proportion with the charge applied to it.

In accordance with this charge, the toner adheres to this charge carrier, which is structured as a cylinder in the example used here. The charge carrier therefore carries a certain toner pattern of a first color, charge carrier 13 carries a certain toner pattern of a second color, charge carrier 14 carries a certain pattern of a third color, and charge carrier 15 carries a certain pattern of a fourth color.

Carrier band 5 contacts charge carriers 12, 13, 14, 15. When it contacts charge carrier 12, the charge pattern with the first color is transferred to band 5. The charge pattern transferred from charge carrier 12 to the band is transported further by carrier band 5, to charge carrier 13. Charge carrier 13 applies the pattern located on charge carrier 13, with the second color, to carrier band 5. When carrier band 5 is turned further, it reaches charge carrier 14, which adds the corresponding charge pattern with the corresponding color. When band 5 is turned further, charge carrier 15 is reached, and it also applies its charge pattern with the corresponding color to the band, as described above.

After having passed by the last charge carrier 15, a four-color toner image is located on carrier band 5. This toner image is passed to toner pressure roller pair 6 by the carrier band 5. Via transport rollers 3, the paper to be printed is also passed to toner pressure roller pair 6. Both paper 2, which has been fed in, and the toner image, fed in via carrier band 5, are then located in toner pressure roller pair 6.

Toner pressure roller pair 6 has the task of applying the toner image onto the paper by pressure, and thereby generating a first adhesion of the toner on the paper, as well as bringing the bands and the paper together.

When lower paper transport band 4, which runs at the same speed as upper band 5, is turned further, the toner image between paper and band 5 is passed to a heating device 7. This heating device 7 heats upper band 5, which causes the toner that is in contact with upper band 5 to be heated. The heating energy to be applied depends on the time available for heating the toner at heating device 7, in order to melt the toner. The liquid toner flows into the fiber structure of the paper surface. A roller pair 21 at the end of the heating device presses the melted toner onto the paper. If the heating segment is sufficiently long, the heating temperature can be correspondingly lower.

When the paper is transported further by the rotation of bands 4 and 5, the paper reaches a cooling device 8. The cooling temperature depends on the time which is available for cooling the paper at the cooling device 8, in order to cool the toner and the paper, respectively. If the cooling segment is sufficiently long, the cooling temperature can be correspondingly lower. This cooling device 8 cools the bottom of paper 2, i.e. the side of paper 2 which lies on the transport band, until the toner particles have solidified again.

The adhesion forces of the toner particles on upper band 5 are less than the adhesion forces on the paper.

When the bands of transport band 4 and upper band 5 are turned further, the paper is passed once again through a toner pressure roller pair 9, which again presses the applied toner and paper 2 together.

Upper carrier band 5 is deflected immediately after toner pressure has been applied, by toner pressure roller 9, and is passed to first charge carrier 12. By this deflection of upper band 5, a separation of upper band 5 from the toner and from paper 2 takes place.

Since the heat between upper band 5 and the toner, generated by heating device 7, lowers the attraction force between toner and upper band 5, and since the cold generated by means of cooling device 8 supports the attraction force of the toner to the paper, the toner releases from upper band 5 more easily than from cooled paper 2.

Paper 2, which has been printed in this manner, and contains almost one hundred percent toner application, is passed to delivery 11 via transport rollers 10.

Upper carrier band 5 is passed by a cleaning device 20, which is located ahead of first charge carrier 12, this cleaning device 20 having the task of removing any toner residues which might have remained. Cleaning devices 16, 17, 18, 19 have the same task; they remove any toner residues which might have remained on charge carriers 12, 13, 14, 15.

FIG. 1 shows an exemplary embodiment in which heating first takes place for a certain segment, via heating device 7, and cooling only takes place subsequently, via cooling device 8. Within the scope of the invention, it is possible, however, that both heating and cooling act on the toner and the paper, respectively, at the same time. It is therefore not necessary for the present invention that there must be a time delay between heating and cooling.

What is claimed is:

1. A method for applying toner to a substrate to be printed by a printing unit, the method comprising the steps of:

applying a print image to a carrier band, the carrier band passing through an elongated segment of the printing unit;

transferring the print image to a first side of the substrate, the transferring occurring in the elongated segment;

transporting the substrate via a transport band, the transporting occurring between the carrier band and the transport band at the elongated segment;

heating the substrate in the elongated segment at the first side of the substrate through the carrier band before and/or during the transferring step so that toner of the print image penetrates into the substrate; and cooling the substrate in the elongated segment at a second side of the substrate through the transport band so as to solidify the penetrated toner of the print image in the substrate, the cooling occurring at a same time as the heating in at least a portion of the elongated segment;

pressing the carrier band against the substrate using the transport band and at least one pair of rollers; and pressing melted toner into the substrate after the heating step using one pair of the at least one pair of rollers;

wherein a heating energy and a cooling energy to be supplied during the heating and cooling steps are capable of being adjusted as a function of a printing speed of the printing unit.

2. A printing machine for applying toner to a substrate comprising:

a carrier band for carrying a toner image;

a transport band for transporting the substrate between the carrier band and the transport band at an elongated segment of the printing machine;

a heating device for heating the substrate in the elongated segment at a first side of the substrate through the carrier band so that toner of the toner image from the carrier band penetrates into the substrate; and a cooling device for cooling the substrate in the elongated segment at a second side of the substrate through the transport band so as to solidify the penetrated toner in the substrate, the cooling occurring at a same time as the heating in at least a portion of the elongated segment; and at least one pair of rollers for pressing the carrier band and the transport band together, one of the at least one pair of rollers being disposed at an end of the elongated segment.

* * * * *